US010565878B2

(12) United States Patent
Becker et al.

(10) Patent No.: US 10,565,878 B2
(45) **Date of Patent: *Feb. 18, 2020**

(54) DISTRIBUTED REMOTE SENSING SYSTEM GATEWAY

(71) Applicant: fybr, Chesterfield, MO (US)

(72) Inventors: Paul Becker, Eureka, MO (US); Richard E. Goodwin, St. Louis, MO (US); Edwin Horton, Wildwood, MO (US)

(73) Assignee: fybr, Chesterfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/281,040

(22) Filed: May 19, 2014

(65) Prior Publication Data

US 2014/0340243 A1 Nov. 20, 2014

Related U.S. Application Data

(60) Provisional application No. 61/824,630, filed on May 17, 2013.

(51) Int. Cl.

| | |
|---|---|
| ***G08G 1/01*** | (2006.01) |
| ***G08G 1/14*** | (2006.01) |
| ***G08G 1/04*** | (2006.01) |

(52) U.S. Cl.

CPC ..... *G08G 1/144* (2013.01); *G08G 1/04* (2013.01)

(58) Field of Classification Search

None

See application file for complete search history.

(56) References Cited

U.S. PATENT DOCUMENTS

| | | | | |
|---|---|---|---|---|
| 4,321,589 | A | 3/1982 | King | |
| 4,626,850 | A | 12/1986 | Chey | |
| 5,182,564 | A | 1/1993 | Burkett et al. | |
| 5,640,386 | A * | 6/1997 | Wiedeman | 370/320 |
| 6,427,913 | B1 | 8/2002 | Maloney | |
| 6,502,053 | B1 | 12/2002 | Hardin et al. | |
| 7,104,447 | B1 | 9/2006 | Lopez et al. | |
| 7,113,127 | B1 | 9/2006 | Banet et al. | |
| 8,031,650 | B2 | 10/2011 | Petite et al. | |
| 8,223,010 | B2 * | 7/2012 | Petite et al. | 340/539.1 |
| 2003/0169183 | A1 | 9/2003 | Korepanov et al. | |
| 2004/0075582 | A1 | 4/2004 | Bergan et al. | |

(Continued)

FOREIGN PATENT DOCUMENTS

| | | |
|---|---|---|
| JP | 7302398 | 11/1995 |
| JP | 2000343203 | 12/2000 |

(Continued)

OTHER PUBLICATIONS

International Search Report of International Application No. PCT/US14/38592, dated Oct. 2, 2014.

(Continued)

*Primary Examiner* — Julie B Lieu

(74) *Attorney, Agent, or Firm* — Perman & Green

(57) ABSTRACT

A distributed remote sensing system including a group of gateways and a sensing device group associated with each gateway in the group of gateways wherein the sensing device group associated with one gateway is different than another sensing device group associated with a different gateway.

26 Claims, 4 Drawing Sheets

(56) References Cited

U.S. PATENT DOCUMENTS

| | | | | |
|---|---|---|---|---|
| 2004/0212500 | A1* | 10/2004 | Stilp | 340/541 |
| 2005/0218465 | A1 | 10/2005 | Cummins | |
| 2005/0226201 | A1* | 10/2005 | McMillin | 370/348 |
| 2006/0197650 | A1 | 9/2006 | Jones et al. | |
| 2007/0050240 | A1 | 3/2007 | Belani et al. | |
| 2007/0085067 | A1 | 4/2007 | Lewis | |
| 2007/0093974 | A1 | 4/2007 | Hoogenboom | |
| 2008/0165030 | A1* | 7/2008 | Kuo et al. | 340/932.2 |
| 2009/0310571 | A1 | 12/2009 | Matischek et al. | |
| 2009/0322510 | A1* | 12/2009 | Berger | G06Q 10/08 340/539.1 |
| 2010/0194565 | A1 | 8/2010 | Houston | |
| 2011/0082991 | A1 | 4/2011 | Leman et al. | |
| 2011/0178703 | A1* | 7/2011 | Aben et al. | 701/207 |
| 2011/0218940 | A1 | 9/2011 | Bergstrom | |
| 2011/0257935 | A1 | 10/2011 | De Graaf et al. | |
| 2011/0273323 | A1 | 11/2011 | Bays | |
| 2011/0298603 | A1 | 12/2011 | King et al. | |
| 2011/0298634 | A1* | 12/2011 | Beverung et al. | 340/870.02 |
| 2011/0309953 | A1 | 12/2011 | Petite et al. | |
| 2011/0316716 | A1* | 12/2011 | MacKay et al. | 340/870.02 |
| 2012/0079149 | A1 | 3/2012 | Gelvin et al. | |
| 2012/0098677 | A1* | 4/2012 | Geelen | 340/932.2 |
| 2012/0182160 | A1 | 7/2012 | Hod | |
| 2012/0185569 | A1* | 7/2012 | Das et al. | 709/219 |
| 2012/0286968 | A1* | 11/2012 | Jones et al. | 340/870.02 |
| 2012/0307681 | A1* | 12/2012 | Hirata et al. | 370/254 |
| 2012/0307711 | A1* | 12/2012 | Yoon et al. | 370/315 |
| 2013/0038461 | A1* | 2/2013 | Hawkes et al. | 340/815.4 |
| 2013/0201316 | A1* | 8/2013 | Binder et al. | 348/77 |
| 2013/0214937 | A1* | 8/2013 | Petite et al. | 340/870.03 |
| 2014/0108107 | A1* | 4/2014 | Jones et al. | 705/13 |
| 2014/0214499 | A1 | 7/2014 | Hudson et al. | |
| 2014/0214500 | A1 | 7/2014 | Hudson et al. | |
| 2014/0324614 | A1* | 10/2014 | Kulkarni et al. | 705/26.1 |
| 2014/0324615 | A1* | 10/2014 | Kulkarni et al. | 705/26.1 |
| 2014/0340243 | A1* | 11/2014 | Becker et al. | 340/933 |
| 2014/0342734 | A1* | 11/2014 | Tsuda | 455/434 |
| 2015/0108901 | A1* | 4/2015 | Greene et al. | 315/149 |

FOREIGN PATENT DOCUMENTS

| | | |
|---|---|---|
| JP | 2001202544 | 7/2001 |
| JP | 3096291 | 7/2003 |
| JP | 2005085187 | 3/2005 |
| JP | 2007317098 | 6/2007 |
| JP | 2009260778 | 11/2009 |
| WO | 2010069002 | 6/2010 |

OTHER PUBLICATIONS

International Search Report, International Application No. PCT/US2014/038588, dated Sep. 29, 2014.

International Search Report, International Application No. PCT/US2014/038585, dated Nov. 25, 2014.

* cited by examiner

DISTRIBUTED REMOTE SENSING SYSTEM GATEWAY

CROSS-REFERENCE TO RELATED APPLICATIONS

This application is a non-provisional of and claims the benefit of U.S. provisional patent application No. 61/824,630 filed on May 17, 2013, the disclosure of which is incorporated by reference herein in its entirety.

BACKGROUND

1. Field

The exemplary embodiments generally relate to distributed remote sensing systems and, more particularly, to distributed remote sensing systems having remote sensors for sensing a predetermined physical characteristic.

2. Brief Description of Related Developments

Parking monitoring/detection systems have traditionally been used to raise revenue. Such devices have included a timer and a winding mechanism requiring coins. More recently, electronic meters have been developed which include an electronic timer having an LCD time indicator.

With the advent of electronic parking monitoring devices, attempts have been made to make the parking monitors interactive with vehicle traffic in the associated parking space. One way to obtain information about vehicle traffic at parking spaces is to couple the parking monitor to a vehicle sensing device. The vehicle sensing device can detect when a vehicle enters a parking space as well as when the vehicle leaves. Attempts have also been made to centralized vehicle parking space monitoring where data collected by the vehicle sensing devices is ultimately transferred to a centralized monitoring location for analysis and application to user accounts.

Generally, the vehicle sensing devices and communication means between the vehicle sensing devices and the centralized monitoring location must be powered. It may be prohibitive to provide hard lined power to each vehicle sensing device and each communication means. As such, the vehicle sensing devices and communications means may have limited power supplies. The parking monitoring system components are also subject to failure and/or outages.

It would be advantageous to have a distributed remote sensing system that improves reliability through one or more redundancies in the system as well as improve power management of the system components.

BRIEF DESCRIPTION OF THE DRAWINGS

The foregoing aspects and other features of the disclosed embodiment are explained in the following description, taken in connection with the accompanying drawings, wherein.

DETAILED DESCRIPTION

Figure 1:
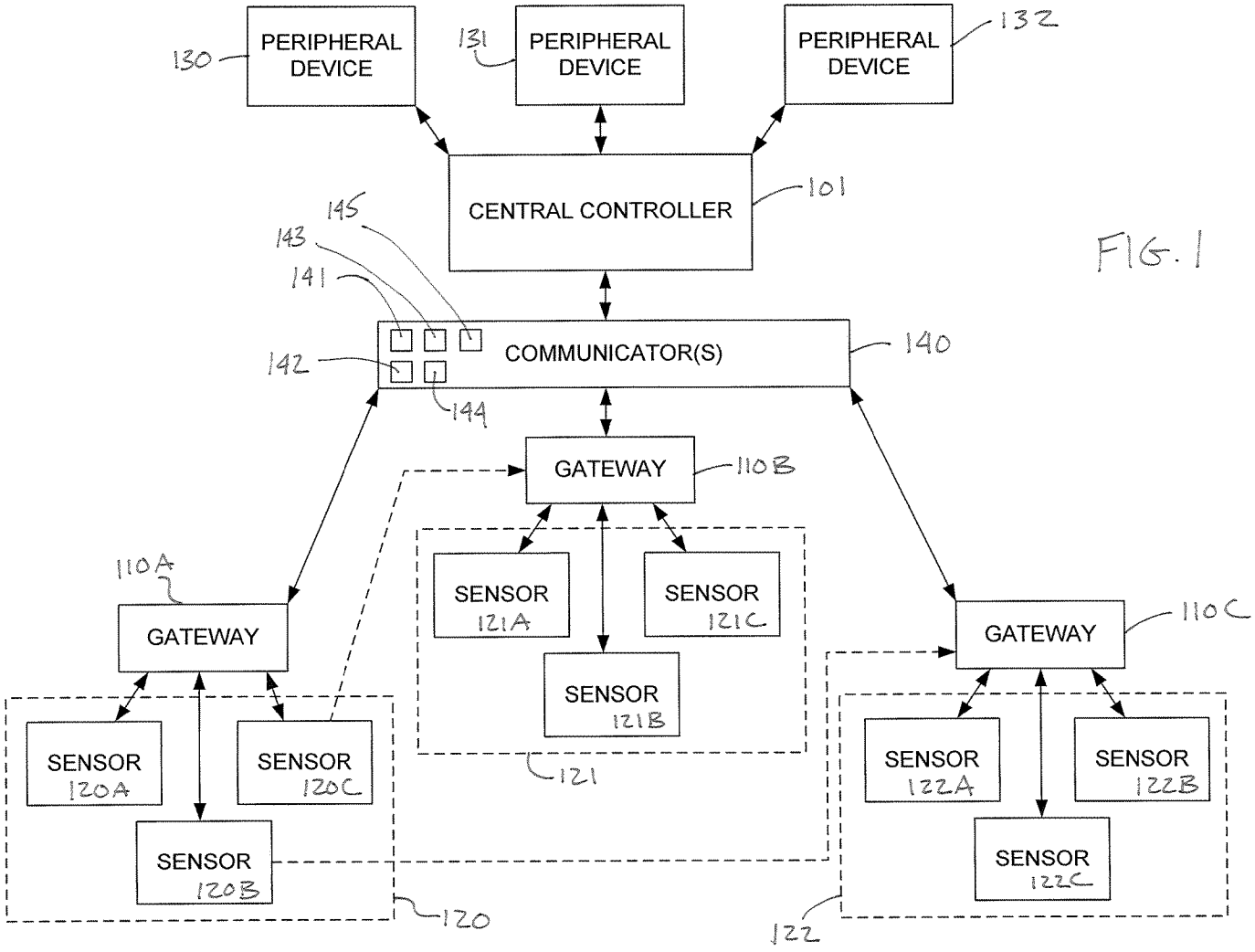
FIG. 1 is a schematic illustration of a portion of vehicle parking meter system in accordance with aspects of the disclosed embodiment.

FIG. 1 is a schematic illustration of a portion of a distributed remote sensing system in accordance with aspects of the disclosed embodiment. The distributed remote sensing system may include remote sensors for sensing characteristics such as vehicle detection, traffic patterns, vehicle navigation, vehicle position or any suitable predetermined characteristic. Although the aspects of the disclosed embodiment will be described with reference to the drawings, it should be understood that the aspects of the disclosed embodiment can be embodied in many forms. In addition, any suitable size, shape or type of elements or materials could be used.

In one aspect the distributed remote sensing system may be a vehicle parking meter/detection system 100 having a centralized controller that may provide at least monitoring and/or billing services for the use of one or more vehicle parking spaces. In one aspect, the vehicle parking meter system 100 may include a central controller 101, one or more gateways 110A-110C, one or more sensing device groups 120-122 and one or more peripheral devices 130-132 which may include any suitable display for displaying any suitable information pertaining to one or more parking spaces. In other aspects the vehicle parking meter system may include any suitable number and type of components to facilitate the monitoring of the vehicle parking spaces associated with the vehicle parking meter system 100. The central controller 101 may be any suitable controller capable of communicating with the one or more gateways 110A-110C (and sensing devices in communication with the one or more gateways) and the one or more peripheral devices 130-132 using any suitable wireless or wired communication interface link that extends from the sensing devices to the central controller and from the central controller to the peripheral devices (it is noted that the interface may include a single communication protocol or a combination of different communication protocols). In one aspect communication between at least the central controller 101 and one or more of the gateways 110A-110C and/or peripheral devices 130-132 may be through a cellular communication link 141, a satellite communication link 142, public switched telephone network 145, Internet/World Wide Web 143, Ethernet 144, local area network or other suitable wireless or wired protocol or connection. In one aspect communications from the sensing devices in the sensing device groups 120-122 may be provided substantially in real time to the central controller 101 and/or peripheral devices 130-132.

The central controller 101 may include one or more processors, a memory and any other suitable hardware/software configured to track and report, for each parking space being monitored, a user of the parking space, parking space assignments/allocations, time of arrival, time of departure, transaction rates, user account monetary balances, billing transactions, parking violations, parking space availability or any other suitable information pertaining to the use and billing of each parking space monitored by the vehicle parking meter system 100. The central controller 101 may be configured with one or more user interfaces to allow user access to and operation of the central controller 101. In one aspect the central controller 101 may be any suitable computing device having a monitor, keyboard and/or other suitable user interface. In other aspects, one or more of the peripheral devices 130-132 may provide a user interface for accessing and operating the central controller 101 either through any suitable long or short range wireless communication link and/or through a wired connection. The central controller 101 may be configured to receive any suitable data from the sensing devices. The data sent from the sensing devices may include or otherwise embody, for example, any suitable data related to a parking space being monitored, vehicle detection, and or a health and welfare/maintenance status of the sensing device. In one aspect the central controller may be configured to perform any suitable processing on the data from the sensing devices while in other aspects the data from the sensing devices may be configured, e.g. without processing by the central controller, for display on one or more of the peripheral devices.

In one aspect one or more of the peripheral devices 130-132 may include, for example, an enforcement unit which may be a hand held unit for use by parking/law enforcement personnel. The enforcement unit may be configured to report parking violations and/or the issuance of parking tickets to the central controller 101 so that electronic ticketing and data capture is integrated into the distributed remote sensing system. For example, a law enforcement officer using a peripheral device 130-132 may arrive at a parking space after being notified of a violation and make a visual inspection of the parking space to verify that there is a vehicle in violation of a law. The violation may be entered into the peripheral device 130-132 and optionally pictures of the vehicle in violation can be taken with the peripheral device or otherwise loaded into the peripheral device. A citation may be generated in any suitable manner, such as being printed from the peripheral device 130-132 and affixed to the vehicle in any suitable manner. The enforcement unit may also report any other actions taken by, for example, the parking enforcement personnel and/or any other suitable information to the central controller 101. As such, violation data entered into the peripheral device is automatically captured and stored in a memory, such as a memory of the central controller 101 in substantially real time. As may be realized storing the violation information within the distributed remote sensing system stops the system from alerting an enforcement office to that space until another violation threshold is met or a new vehicle parks in the space. In another aspect, the sensing devices may also be used in non-parking spaces such as in front of fire hydrants, fire lanes, cross walks, intersections, etc. The distributed remote sensing system can be configured to create a violation after any suitable predetermined time period whenever a vehicle is parked in one of these non-parking spaces so that an alert is sent to an enforcement officer through, for example, a peripheral device 130-132. As may be realized, the distributed remote sensing system may incorporate any other suitable sensors such as cameras and infrared sensors that may be used in conjunction with the sensing devices of the sensor groups 120-122. Information from the cameras and/or infrared sensors may be used in conjunction with the violation data provided by the sensing devices of the sensor groups 120-122 to track violations and the history of the violations. The violation history can be printed from, e.g., a peripheral device 130-132 for adjudication purposes, including parking sensor time stamps of vehicle entry/exit from a parking space.

The one or more of the peripheral devices 130-132 may also include, for example, a motorist unit which may be a handheld unit for use by motorists accessing the parking spaces that are monitored by the vehicle parking meter system 100. In one aspect the motorist unit may be a dedicated vehicle parking meter system hand held unit while in other aspects the motorist unit may be integrated into a user's wireless phone, vehicle GPS unit, or other user computing device such as through an application program capable of running on the wireless phone, GPS unit or other computing device. In still other aspects the motorist unit may be implemented in any suitable manner for allowing the motorist to, for example, check an account balance, add funds to the user's account, perform billing/violation payment transactions, find available parking spaces or any other suitable action(s) such as reserving one or more parking spaces for a predetermined time and date. The motorist unit may provide a motorist with way finding information, e.g. based on data provided by the sensing devices, that includes a substantially real time view of the availability of parking (and routing thereto) throughout the deployment area of the distributed remote sensing system. The motorist unit may be configured to allow a user to select a location and see how full the parking spaces are in an area using, for example, color coded or other suitable indicators. Pricing to park in each parking space may also be provided. The way finding information provided by the motorist unit may also allow a user to keep track of where they park. In one aspect the motorist unit may include or be used in conjunction with a global positioning system or other mapping data to provide a user with traffic information related to the parking spaces so that the user can select, for example a parking lot exit or street that is not congested with vehicles leaving parking spaces monitored by the distributed remote sensing system.

As noted above the central controller 101 may be connected to the one or more gateways 110A-110C (and to the sensing devices) in any suitable manner. In one aspect one or more communicators 140 may be used as a communication link between the gateways 110A-110C and the central controller 101. The one or more communication links 140 may include, for example, one or more cell towers/providers in a cellular communication network. In other aspects the one or more communication links 140 may include, for example, one or more satellites in a satellite communication network, a public switched telephone network, Internet/World Wide Web access points or any other suitable communication access points such as those used in the wired and/or wireless communication protocols described above. In still other aspects the one or more communication links 140 may be a combination of cellular and satellite communication or any other suitable wired or wireless communication link.

Figure 2:
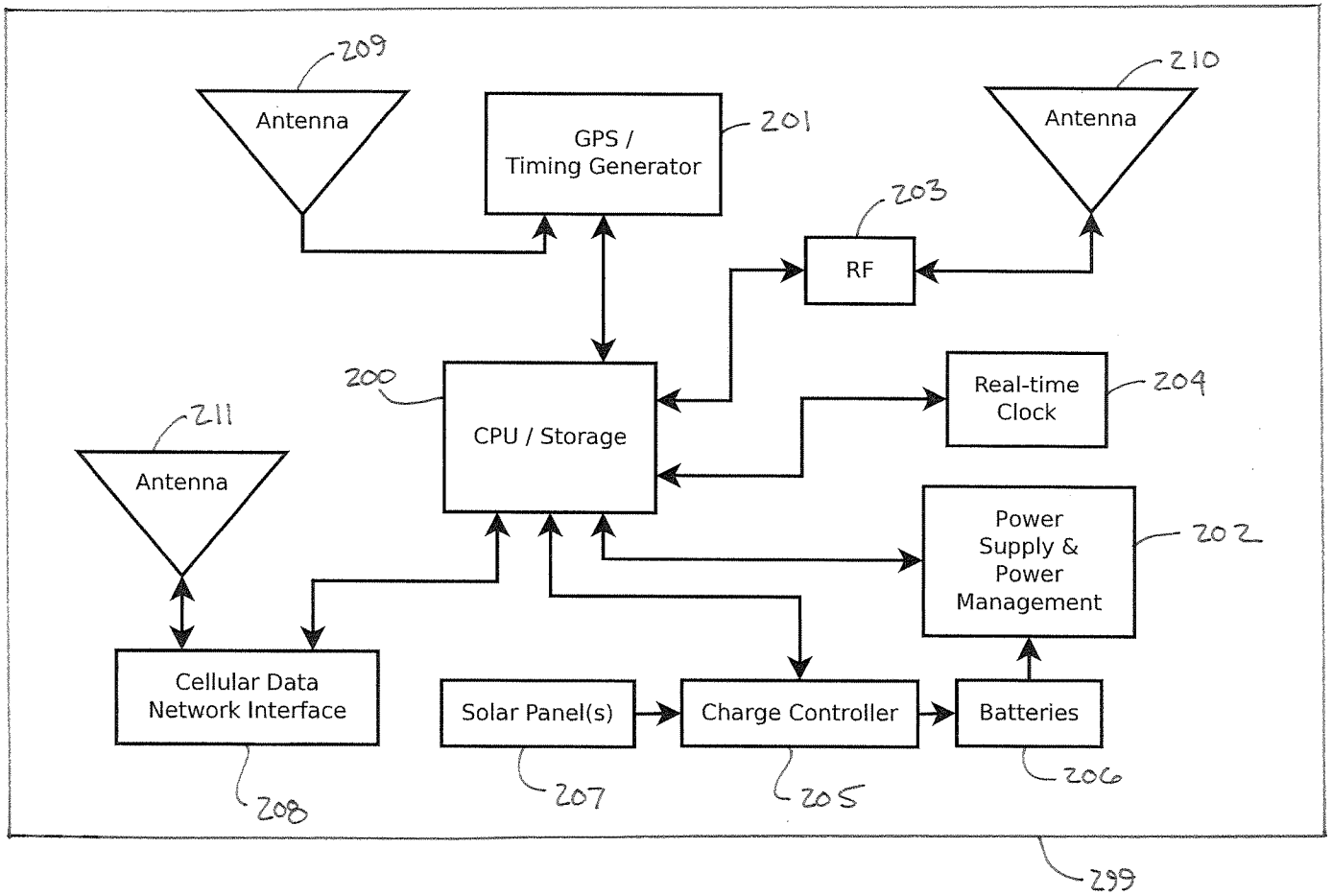
FIG. 2 is a schematic illustration of a portion of the vehicle parking meter system of FIG. 1 in accordance with aspects of the disclosed embodiment.

Referring also to FIG. 2, each of the gateways 110A-110C may include any suitable housing 299 having any suitable shape and size. In one aspect the housing is weatherproof and may be UV (ultraviolet) ray resistant. The housing 299 may be constructed of any suitable material so that, in one aspect, radio frequencies are allowed to pass through the housing. Each gateway 110A-110C (generally referred to as gateway 110) may include, e.g. within a respective housing, a processor module 200 (which may include any suitable memory and suitable programming and may be configured for performing the functions of the gateway as described herein), GPS module 201, a clock module 204, a charge controller 205, a power supply module 202 and any suitable number of communication modules 203, 208.

The GPS module 201 may be operably connected to the processor module 200 and include any suitable antenna 209 for communicating with one or more GPS satellites. The GPS module 201 may be configured to provide any suitable data to the processor module 200 including, but not limited to location/positioning data, date data and time data. The clock module 204 may be operably connected to the processor module 200 and provide the processor module 200 with time data which may be periodically (or at any suitable time(s)) updated by the processor module 200 using date and/or time data obtained from the GPS module 201.

The charge controller 205 may be operably connected to the processor module 200 in any suitable manner. One or more solar panels 207 may be disposed on, located remotely from or otherwise connected to the housing 299. In one aspect, the one or more solar panels 207 may be movable and configured in any suitable manner to track one or more available light sources, such as e.g. the best light source, to optimize a recharge cycle of one or more power storage units 206. Here the one or more solar panels 207 may include any suitable motors and light sensors for effecting light tracking movement of the one or more solar panels 207. As may be realized, the motors and light sensors may be connected to the processor module 200 for any necessary calculations and control for effecting the light tracking movements. In other aspects the solar panels 207 may include a processor for performing the necessary calculations to effect the light tracking movement. The solar panels 207 may be operably connected to the charge controller 205 for charging the one or more rechargeable power storage units 206. In one aspect the gateway 110 may be configured to operate substantially from power provided by the one or more solar panels 207 during lighted conditions (e.g. during the day) and substantially from power provided by the one or more rechargeable power storage units 206 during unlighted or low light conditions (e.g. at night, dusk, dawn, etc.). In other aspects the gateway 110 may be configured to operate from power provided by a combined output of the one or more solar panels 207 and the one or more power storage units 206. In still other aspects the gateways may be powered with a hard line such as from a utility source and include suitable electronics for converting the utility power to power that is usable by the gateway.

The power supply 202 may be operably connected to the processor unit 200 and the one or more power storage units 206 to provide and manage power from the one or more power storage units 206 and/or solar panels 207 for the operation of the gateway 110. In one aspect, the power supply module 202 may provide a charge status of the one or more power storage units 206 to the processor module 200. The processor module 200 may be configured, e.g. when the charge status reaches a predetermined threshold or at any other suitable time, to effect operation of the charge controller 205 so that power is transmitted from the one or more solar panels 207 to the one or more power storage units 206 for charging the one or more power storage units 206. The power supply module 202 may also provide predictive maintenance that monitors, for example, the charge cycles of the one or more power storage units 206. The processor module 200 may be configured to determine or otherwise predict a life of the one or more power storage units 206 using data from, for example, the power supply module 202, such as a voltage/current curve of the one or more solar panels 207 and/or the charge cycles of the one or more power storage units 206. The processor module 200 may cause a message (including a status/life of the one or more power storage units 206) to be sent from the gateway 110 to the central controller 101 for communication to any suitable operator/maintenance personnel of the vehicle parking meter system 100.

In one aspect the gateway 110 may include two communication modules 203, 208. One of the communication modules 203 may be a "local" communication module configured for, e.g., communication with respective sensing devices 120A-120C, 121A-121C, 122A-122C over any suitable wireless protocol such as a cellular, satellite or other long or short range communication protocol. Another of the communication modules 208 may be a "distant" communication module configured for, e.g., communication with the one or more communicators 140 using, for example, antenna 211 as will be described in greater detail below. In other aspects, a single communicator may be used to communicate with both the sensing devices 120A-120C, 121A-121C, 122A-122C and the one or more communicators 140.

In one aspect any suitable antenna 210 may be connected to the communication module 203 for allowing any suitable radio frequency communication with the sensing devices 120A-120C, 121A-121C, 122A-122C. The antenna 210 may be disposed within the housing 299, mounted to or remotely located from the housing 299. In one aspect the antenna 210 may be a directional antenna that is rotatable/swivelable to point in the direction of a sensing device 120A-120C, 121A-121C, 122A-122C for transmitting information to or receiving information from the sensing device 120A-120C, 121A-121C, 122A-122C. The directional antenna may improve gains received by the gateway 110 by directing the antenna at the sensing devices 120A-120C, 121A-121C, 122A-122C. In one aspect the antenna 210 may be mounted on a rotatable mount and include any suitable drive motor for rotating the antenna. The processor module 200 may include a memory that is configured to store a directional orientation of the antenna 210 for each of the sensing devices 120A-120C, 121A-121C, 122A-122C communicating with the gateway. This directional orientation for each sensing device 120A-120C, 121A-121C, 122A-122C may be established using a line of sight alignment while in other aspects the directional orientation may be substantially automatically established and/or fine-tuned using a signal strength of a sensing device communication. For example, the processor unit 200 may use the antenna 210 to monitor the signal strength of messages coming from the sensing devices and adjust the directional orientation of the antenna 210 so that a maximum or best possible signal strength is obtained and the directional orientation for the respective sensing device is stored in memory. Adjustments to the directional orientation of the antenna 210 may be made as necessary by the gateway 110. In one aspect, upon installation of a new or additional sensing device 120A-120C, 121A-121C, 122A-122C the gateway 110 may be configured to automatically detect the new or additional sensing device by sweeping the antenna 210 through the operational area of the gateway and record the directional orientation of the antenna 210 for communicating with the new or additional sensing device based on the signal strength of a message transmitted from that new or additional sensing device. In other aspects the antenna 210 may be an omnidirectional antenna.

Figure 3:
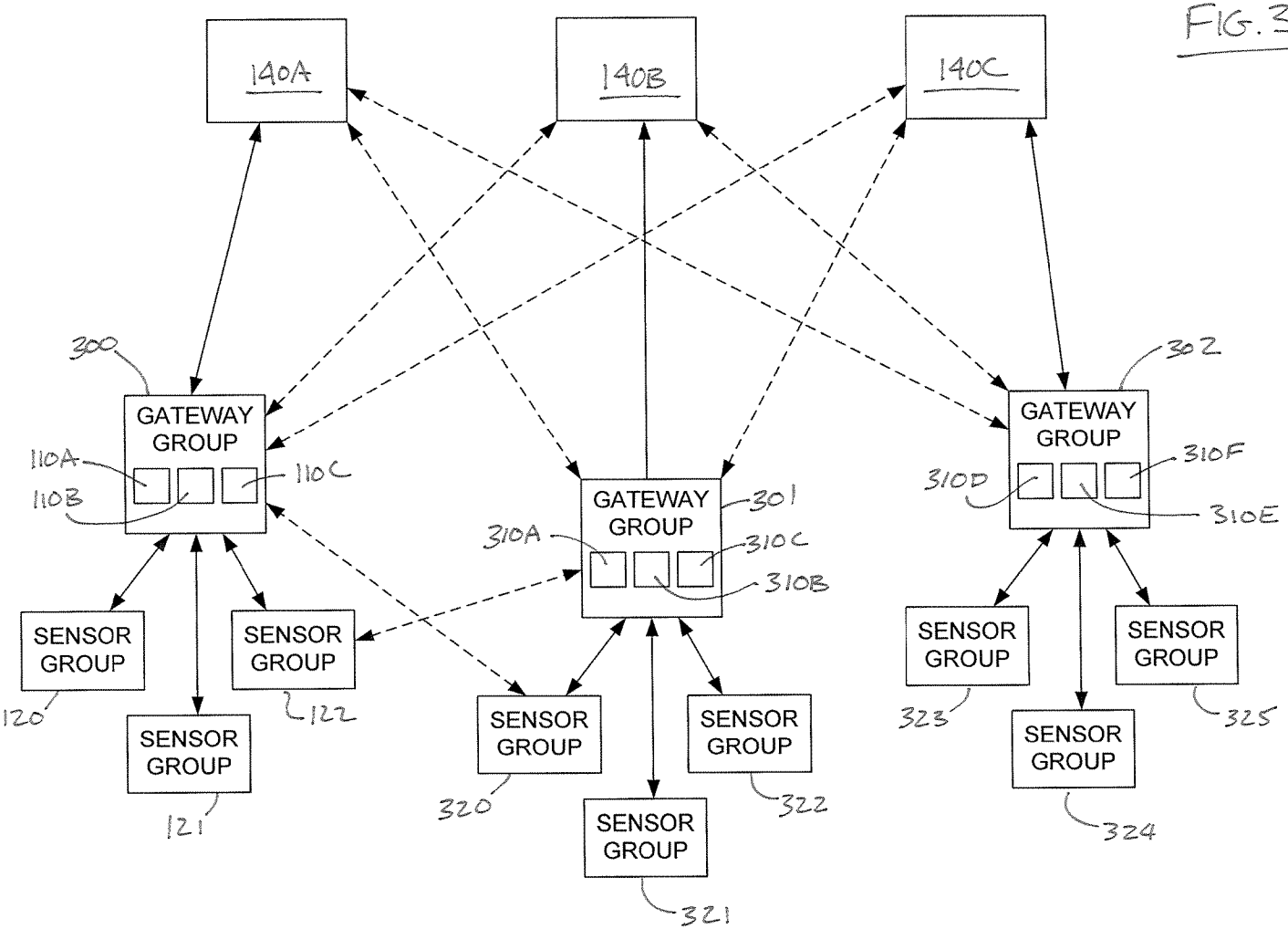
FIG. 3 is a schematic illustration of a portion of the vehicle parking meter system of FIG. 1 in accordance with aspects of the disclosed embodiment.

Referring again to FIG. 1 and FIG. 3, in operation, there may be groups of gateways 300-302 each having one or more gateways 110A-110C, 310A-C, 300D-310F where each gateway is in communication with the central controller 101 through, for example, one or more communicators 140 which in this aspect are cellular providers 140A, 140B, 140C. Using gateway group 300 and associated sensing device groups 120-122 as an example, several levels of redundancy may be provided for communication within the vehicle parking meter system 100. As will be explained in greater detail below there may be one level of redundancy with respect to communication between the sensing devices within the sensing device groups 120-122 and the gateways 110A-110C. There may be another level of redundancy between communications between the gateways 110A-110C and the communicators 140A-140C. There may also be a level of redundancy with respect to communications from the sensing devices where sensing device messages are stored within a gateway 110A-110C when one or more gateways and the communicators 140A-140C are unavailable.

As noted above, each gateway 110A-110C may be paired with its own group 120, 121, 122 of sensing devices. The sensing devices 120A-120C, 121A-121C, 122A-122C may be any suitable sensing devices such as those described in U.S. Provisional Patent Applications having provisional patent application Nos. 61/824,512 and 61/824,609 filed on May 17, 2013 (now United States non-Provisional patent applications filed on May 19, 2014), the disclosures of which are incorporated herein by reference in their entireties. In one aspect the sensing devices may detect the arrival and departure of vehicles within associated parking spaces. For example, one or more sensing devices may be located (e.g. such as embedded in the road surface or otherwise) in each parking space monitored by the vehicle parking meter system 100. Each gateway 110A-110C in the group of gateways 300 may provide a redundancy for communication with the sensing device groups 120-122. In one aspect the gateways may be arranged or otherwise positioned throughout a deployment area of the vehicle parking meter system 100 so that each sensing device is capable of communicating with at least two gateways. As an example, gateway 110A may be paired as a primary gateway with sensing devices 120A-120C within sensing device group 120 (e.g. that define a primary sensing device group for gateway 110A) and paired as a secondary gateway with sensing devices within sensing device groups 121, 122 (e.g. that define secondary sensing device groups for gateway 110A). Gateway 110B may be paired as a primary gateway with sensing devices 121A-121C within sensing device group 121 (e.g. that define a primary sensing device group for gateway 110B) and paired as a secondary gateway with the sensing devices of sensing device groups 120, 122 (e.g. that define secondary sensing device groups for gateway 110B). Gateway 110C may be paired as a primary gateway with sensing devices 122A-122C within sensing device group 122 (e.g. that define a primary sensing device group for gateway 110C) and paired as a secondary gateway with sensing devices in sensing device groups 120, 121 (e.g. that define secondary sensing device groups for gateway 110C).

It is noted that a primary gateway is the gateway given priority when communicating with a respective primary sensing device group. Secondary gateways are configured to communicate with their secondary sensing device groups when the primary gateway for those secondary sensing device groups is unavailable. In other words, each gateway 110A-110C in the group of gateways 300 provides each sensing device in each primary sensing device group with a redundant gateway (e.g. if one of the gateways 110A-110C in the group of gateways 300 is unavailable the other gateways 110A-110C within that group of gateways are configured to allow communication with the sensing devices associated with the unavailable gateway). For example, if gateway 110A is unavailable, either one of gateway 110B or gateway 110C allows communication with the sensing devices of sensing device group 120. Each gateway 110A-110C within the group may be prioritized with each other with respect to the redundant communication. The prioritization for communication with a sensing device within a sensing device group 120-122 with a secondary gateway (e.g. which secondary gateway is chosen for communication and in what sequence) may be based on a proximity of a secondary gateway to the primary sensing device group for the unavailable gateway (e.g. so that the least amount of power is used by the sensing devices when communicating with the secondary gateway) or based on any other suitable criteria. In one aspect the gateways 110A-110C are configured to listen for messages from the sensing devices (e.g. primary sensing devices, secondary sensing devices or both) and when a message is received from a sensing device that message is acknowledged by the gateway so that there is an indication sent back to the sensing device that the message was received by the gateway. If the sensing device does not receive an acknowledgement message the sensing device then proceeds to communicate with each of the secondary gateways according to the gateway prioritization until an operational gateway acknowledges the sensing device message.

In one aspect the gateways 110A-110C may be able to communicate with each other and provide health and welfare messages to each other regarding an operational state of the gateway. If one gateway receives a message from another gateway that it is unavailable for communication with its primary sensing device group the gateway receiving that message may listen for messages from the primary sensing device group for the unavailable gateway. The health and welfare message may also be sent to the central controller 200 for system management and monitoring where any unavailability in the system may be addressed by maintenance personnel.

As noted above and still referring to FIG. 3, each gateway may also be configured to communicate with the central controller 101 (FIG. 1) through one or more communicators 140A-140C which in this aspect may be cellular providers. Cellular provider as used herein may refer to a cellular network access point and/or cellular carrier. In other aspects any suitable communication protocols may be used as mentioned above, where each form of communication has one or more access points available to the gateway groups 300-302. In still other aspects each gateway may be connected to one or more communicators 140A-140C over different communication protocols. For example, gateways in group 300 may be connected to communicator 140A over a cellular connection, connected to communicator 140B over a public switched telephone network and connected to communicator 140C over a network connection such as the World Wide Web. Each gateway group 300-302 may be associated or otherwise paired with a predetermined (e.g. a primary) one of the communicators 140A-140C. For example, the pairing between the communicators 140A-140C and each group of gateways 300-301 may be based on, for example, proximity (e.g. so the least amount of power may be used for communication) between each group of gateways and the cellular provider or any other suitable criteria. As may be realized, one communicator 140A-140C may serve as a primary cellular provider for more than one gateway group. Still using gateway group 300 as an example, each gateway 110A-110C may be capable of communicating with at least two cellular providers to provide another level of redundancy in the vehicle parking meter system 100. As an example, referring to FIG. 3, if a gateway 110A-110C in sensing device group 300 is paired with communicator 140A as a primary communicator and with one or more of the communicators 140B, 140C as secondary communicators (FIG. 4, Block 500) which may be prioritized for access in a manner similar to that described above with respect to the gateway access by the sensing devices (e.g. based on proximity so that the gateway chooses the closest available cellular provider so that the lowest power is used by the gateway for communication with the cellular provider, preference of communication protocol—e.g. wired or wireless, etc.). In one aspect, the gateways 110A-110C may be configured to determine the proximity of each communicator 140A-140C to the gateway 110A-110C and communicate with the closest available communicator 140A-140C to effect power consumption efficiency of the gateway 110A-110C. Preference may be given to the communicator 140A by the gateway 110A-110C when communicating with the central controller 101. If the communicator 140A is unavailable the gateway 110A-110C may switch communications to communicate with a secondary communicator 140B, 140C according to any suitable predetermined priority of the secondary cellular providers until an available provider is found (FIG. 4, Block 510) (e.g. the gateway may look for the best communication between the gateway and a communicator). As may be realized the gateway may be configured to receive an acknowledgment message from the communicator 140A-140C and if that acknowledgement message is not received the gateway 110A-110C may then proceed to communicate with the other cellular providers.

Figure 4:
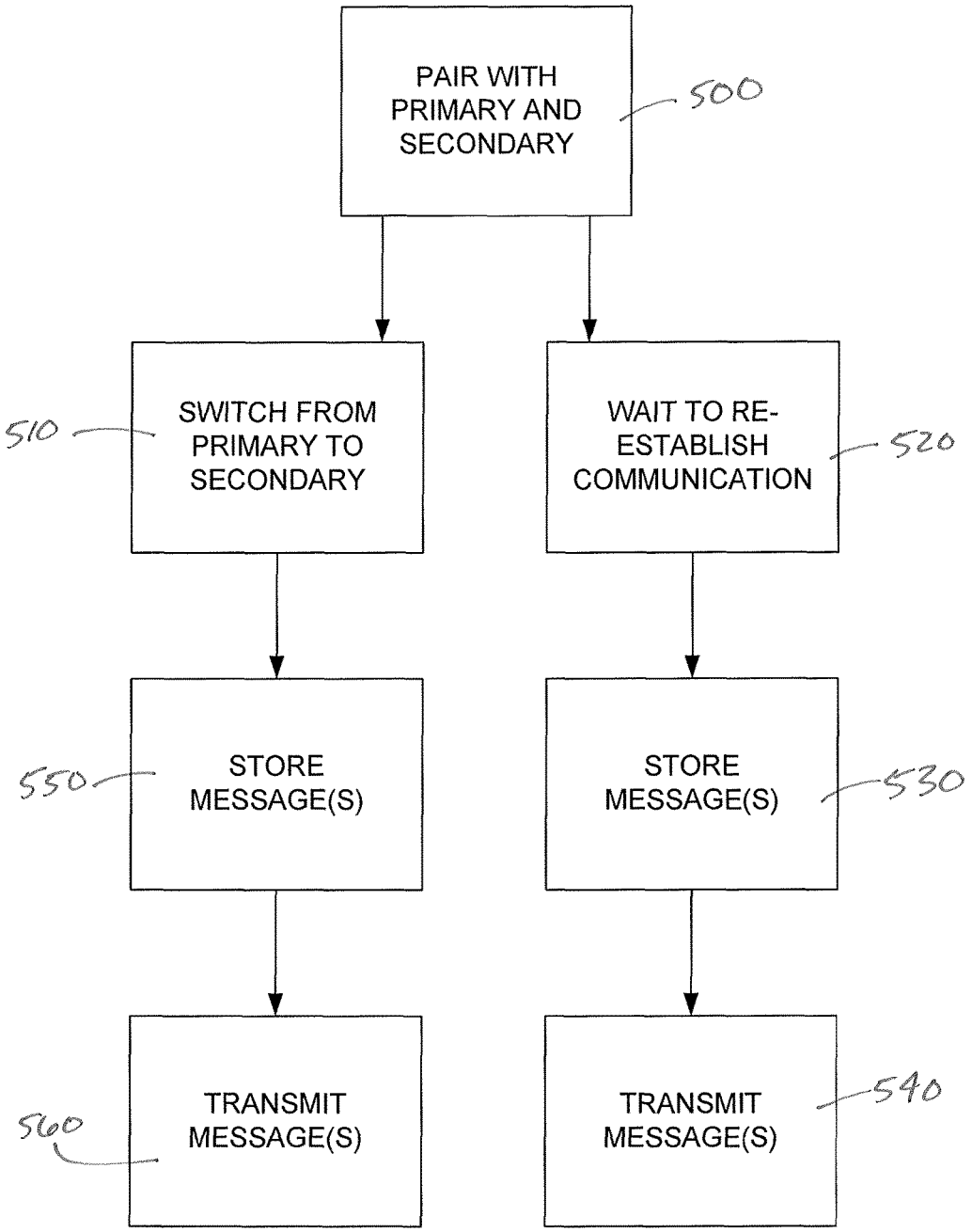
FIG. 4 is a flow chart in accordance with aspects of the disclosed embodiment.

In another aspect the gateway 110A-110C may not switch communicators 140A-140C if its primary communicator becomes unavailable where the gateway 110A-110C is configured to wait to re-establish communication with its primary communicator 140A-140C (FIG. 4, Block 520). In one aspect the gateway 110A-110C may be configured to wait a predetermined length of time before switching between communicators 140A-140C. Here, there may be a level of redundancy with respect to communications from the sensing devices where sensing device messages are stored within a gateway 110A-110C one or more communicators 140A-140C are unavailable. In one aspect, using gateway 110A as an example, gateway 110A may establish communication with communicator 140A (which may be the primary communicator for gateway 110A). If the communicator 140A becomes unavailable the gateway may store messages from the one or more of the sensing device groups 120-122 (e.g. primary sensing devices and/or secondary sensing devices) within a memory of the gateway 110A (FIG. 4, Block 530). The gateway may monitor the availability of the primary communicator 140A and transmit the stored messages when the gateway 110A re-establishes communication with the primary communicator 140A. Each message stored by the gateway 110A is given a time stamp indicating when the message was received by the gateway 110A so that, for example, the arrival, departure, violation, and other messages from the sensing devices can be accurately tracked and applied to user accounts by the central controller 101. When communication is re-established with the communicator 140A the gateway 110A transmits the message with the time stamp to allow the central controller 101 to monitor the activity of the corresponding parking spaces (FIG. 4, Block 540). Where one or more gateways 110A-110C are unavailable and communication with the communicators 140A-140C cannot be established the sensing devices will communicate with the primary and secondary gateways 110A-110C until an available gateway (e.g. referred to herein as a store forward gateway) is found. In this case only the store forward gateway will store the time stamped messages until communication is re-established with either another gateway or at least one of the communicators 140A-140C (FIG. 4, Block 550). In one aspect if the messages are stored in a secondary gateway and communication is re-established with the primary (or other optimal) gateway the secondary gateway may transfer the messages (FIG. 4, Block 560) to the primary gateway for transmission to the central controller 101. If the communicators are unavailable after the transfer of the messages to the primary gateway the primary gateway may store the messages until communication is re-established with the communicators. In another aspect, the secondary gateway may transfer the messages to the central controller when communication is re-established with one or more of the communicators 140A-140C. In still another aspect if there are no available gateways 110A-110C the sensing devices 120A-120C, 121A-121C, 122A-122C time stamp and store the messages and send the stored messages when one or more gateways re-establishes communication with the sensing devices.

In one aspect each gateway 110A-110C communicates with their respective sensing devices 120A-120C, 121A-121C, 122A-122C over any suitable wired or wireless communication interface (that e.g. may be substantially similar to that described above between the gateways and the communicators) in a time division duplexing (TDD) manner using a pseudo random channel sequence. For example, the sensing devices may initiate a message (e.g. that includes data embodying a status of a parking space being monitored and/or a health and maintenance status of the sensing device) that requires or otherwise results in a response from a gateway 110 (either primary or secondary gateway), and "sleeps" or otherwise removes itself from active engagement with the gateway 110 until the sensing device determines that it is time to ready itself for communication with the gateway 110. In one aspect the gateway 110 and the sensing device 400 may communicate over a wireless communication link where the transmission of messages and responses can be sent over any of a plurality of available transmission frequencies. For example, each gateway 110A-110C may transmit continuously using TDD and may be capable of changing communication channels/frequencies (it is noted that the terms channel and frequency are used interchangeably herein) according to a predetermined channel/frequency switching scheme. It is noted that each gateway may have a respective channel/frequency switching scheme that is different from the channel/frequency switching scheme of other gateways. The gateway 110 may hop between any suitable number of frequencies when communicating with the sensing devices 400 over any suitable frequency band. In one aspect, as an example, the gateway 110 may hop between 50 frequencies over a frequency band of 902 Mhz to 928 Mhz while in other aspects the number of frequencies may be more or less than 50 and the frequency band may be higher or lower than 902 Mhz to 928 Mhz. In one aspect with each channel change, an outgoing message is transmitted by the gateway 110A-110C and then the gateway 110A-110C listens for response messages from the respective sensing devices 120A-120C, 121A-121C, 122A-122C. As such, at any given time the gateway 110A-110C is communicating with each of the respective (e.g. primary and secondary) sensing devices 120A-120C, 121A-121C, 122A-122C over a common communication channel. In one aspect the channel rate change may be, for example, approximately 100 mSec and the outgoing message from the gateway 110A-110C may use approximately 40% of the channel communication window allowing for long sensing device response times. In other aspects the channel rate change may be any suitable time interval (e.g. more or less than 100 mSec) and the outgoing message may use any suitable percentage of the channel communication window. The processor module 200 (FIG. 2) of each gateway 110A-110C may be configured with any suitable number of channel hopping sequences such as for example, 256 channel hopping sequences. Each gateway may also be assigned any suitable address identifier such as, for example, a 16 bit address identifier that is unique to each gateway 110A-110C. Each gateway 110A-110C may be configured to broadcast its unique address identifier in, for example, the outgoing message so that the sensing devices may listen for the address identifier and determine which gateway 110A-110C they can communicate with. Once communication is established between the gateway 110A-110C and the respective sensing device(s) 120A-120C, 121A-121C, 122A-122C predetermined parameters of the gateway (such as, e.g., the address identifier and channel hopping sequence) that are needed by the sensing devices for communication with the gateway may be updated at any suitable time such as on an as needed basis or at any suitable predetermined time frequency.

In one aspect the gateway 110A-110C may be configured for adaptive channel/frequency hopping so that a channel is changed and/or avoided when, for example, an error rate for particular channels exceeds a predetermined error rate threshold. As an example, if there is a frequency jam or other error the gateway is configured to select a new channel/frequency to be used in the hopping sequence. It is noted that in one aspect all of the gateways in a gateway group transmit messages substantially at the same time and listen for messages from the sensing devices substantially at the same time to, for example, reduce a possibility of self jamming. In other aspects any number of the gateways in the distributed remote sensing system may transmit at substantially the same time and listen substantially at the same time to, for example, reduce a possibility of self jamming. Similarly it is noted that any suitable number of sensing devices 400 may communicate with the gateways at substantially the same time. The gateway 110A-110C may send a "next hop index" message in every time slot of the outgoing message such that, when compared to a hop index of the sensing devices 120A-120C, 121A-121C, 122A-122C, the next channel being "hopped to" should match in both the gateway hop sequence index and a sensing device hop sequence index. In one aspect several spare channels known to both the gateway 110A-110C and their respective sensing devices 120A-120C, 121A-121C, 122A-122C may be available. The gateway 110A-110C may be configured to dynamically direct the sensing devices to select the spare channel, if that spare channel is a valid spare for the particular channel hopping sequence.

In accordance with one or more aspects of the disclosed embodiment a distributed remote sensing system is provided. The distributed remote sensing system includes a group of gateways and a sensing device group associated with each gateway in the group of gateways wherein the sensing device group associated with one gateway is different than another sensing device group associated with a different gateway.

In accordance with one or more aspects of the disclosed embodiment the distributed remote sensing system comprises a parking monitoring system.

In accordance with one or more aspects of the disclosed embodiment, one gateway in the group of gateways provides a redundant gateway for at least one sensing device of at the least one different gateway.

In accordance with one or more aspects of the disclosed embodiment each sensing device in each sensing device group is a vehicle detection sensor.

In accordance with one or more aspects of the disclosed embodiment each gateway is configured for wireless communication with respective sensing devices.

In accordance with one or more aspects of the disclosed embodiment each gateway includes a swivelable directional antenna for communication with respective sensing devices.

In accordance with one or more aspects of the disclosed embodiment each gateway includes a processor unit configured to control a directionality of the directional antenna.

In accordance with one or more aspects of the disclosed embodiment each gateway includes a solar panel and a power storage unit, where the solar panel effects at least recharging of the power storage unit.

In accordance with one or more aspects of the disclosed embodiment the solar panel provides power for operation of a respective gateway.

In accordance with one or more aspects of the disclosed embodiment each gateway in the group of gateways is prioritized in a communication sequence for providing redundant communication for the at least one sensing device group.

In accordance with one or more aspects of the disclosed embodiment each gateway is configured to time stamp each communication received from a sensing device of the at least one sensing device group.

In accordance with one or more aspects of the disclosed embodiment the distributed remote sensing system includes a central controller, each gateway being configured for communication with the central controller through at least one wireless access point. Each gateway is configured to store time stamped messages from sensing devices when the at least one wireless access point is unavailable.

In accordance with one or more aspects of the disclosed embodiment a distributed remote sensing system is provided. The distributed remote sensing system includes a network of gateways and sensing devices. The network of gateways and sensing devices includes at least one gateway group where each gateway in the gateway group is paired to multiple sensing devices that define a primary sensing device group for a respective gateway. Each gateway providing each sensing device in the primary sensing device group for a different gateway with a redundant gateway.

In accordance with one or more aspects of the disclosed embodiment the distributed remote sensing system comprises a parking monitoring system.

In accordance with one or more aspects of the disclosed embodiment each gateway has a different frequency switching scheme for communicating with the sensing devices.

In accordance with one or more aspects of the disclosed embodiment the distributed remote sensing system includes a central controller, each gateway being configured to communicate with the central controller through a respective wireless access point.

In accordance with one or more aspects of the disclosed embodiment a distributed remote sensing system includes a central controller, at least one wireless access point and a group of gateways where each gateway is paired with a group of sensing devices to define a primary sensing device group and where the group of gateways provide at least two levels of redundancy for communication within the distributed remote sensing system.

In accordance with one or more aspects of the disclosed embodiment the distributed remote sensing system comprises a parking monitoring system.

In accordance with one or more aspects of the disclosed embodiment each of the gateways is configured to switch between more than one of the at least one wireless access point for communication with the central controller when one of the at least one wireless access point is unavailable.

In accordance with one or more aspects of the disclosed embodiment each gateway is configured to store messages from the sensing devices when communication to the central controller through the at least one wireless access point is unavailable.

In accordance with one or more aspects of the disclosed embodiment each gateway is a redundant gateway to a group of sensing devices paired with a different gateway to define a redundant sensing device group.

In accordance with one or more aspects of the disclosed embodiment each gateway communicates with the primary sensing device group and the redundant sensing device group over a common communication channel.

In accordance with one or more aspects of the disclosed embodiment each gateway communicates with respective sensing devices using time division duplexing.

In accordance with one or more aspects of the disclosed embodiment a method includes pairing at least one gateway with a primary communicator and at least one secondary communicator for providing communication between the at least one gateway and a central controller. The method further includes switching from the primary communicator to the at least one secondary communicator when communication between the at least one gateway and the primary communicator is unavailable and storing messages within the at least one gateway when communication between the at least one gateway and the at least secondary communicator is unavailable. The method also includes transmitting the messages when communication with the primary or the at least one secondary communicator is re-established.

It should be understood that the foregoing description is only illustrative of the aspects of the disclosed embodiment. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

What is claimed is:

1. A distributed remote sensing system comprising:

a group of gateways; and a sensing device group associated with each gateway in the group of gateways wherein the sensing device group associated with one gateway is different than another sensing device group associated with a different gateway, wherein each sensing device of the sensing device group is independently associated with the gateway associated with the sensing device group, said independent association between each sensing device and the associated gateway is predefined independently of a relative position between the associated gateway and each sensing device, wherein the independent association effecting the association between the sensing device group and the associated gateway.

2. The distributed remote sensing system of claim 1, wherein the distributed remote sensing system comprises a parking monitoring system.

3. The distributed remote sensing system of claim 1, wherein one gateway in the group of gateways provides a redundant gateway for at least one sensing device of the different gateway.

4. The distributed remote sensing system of claim 1, wherein each sensing device in each sensing device group is a vehicle detection sensor.

5. The distributed remote sensing system of claim 1, wherein each gateway is configured for wireless communication with respective sensing devices.

6. The distributed remote sensing system of claim 1, wherein each gateway includes a swivelable directional antenna for communication with respective sensing devices.

7. The distributed remote sensing system of claim 6, wherein each gateway includes a processor unit configured to control a directionality of the directional antenna.

8. The distributed remote sensing system of claim 1, wherein each gateway includes a solar panel and a power storage unit, wherein the solar panel effects at least recharging of the power storage unit.

9. The distributed remote sensing system of claim 8, wherein the solar panel provides power for operation of a respective gateway.

10. A distributed remote sensing system comprising:

a group of gateways; and a sensing device group associated with each gateway in the group of gateways wherein the sensing device group associated with one gateway is different than another sensing device group associated with a different gateway, wherein each gateway in the group of gateways is prioritized in a communication sequence for providing redundant communication for both the sensing device group and the another sensing device group with the one gateway.

11. The distributed remote sensing system of claim 1, wherein each gateway is configured to time stamp each communication received from a sensing device of the sensing device group.

12. The distributed remote sensing system of claim 1, further comprising a central controller, each gateway being configured for communication with the central controller through at least one wireless access point.

13. The distributed remote sensing system of claim 12, wherein each gateway is configured to store time stamped messages from sensing devices when the at least one wireless access point is unavailable.

14. A distributed remote sensing system comprising:

a network of gateways; and sensing devices;

wherein the network of gateways and sensing devices includes at least one gateway group where each gateway in the gateway group is paired to multiple sensing devices that define a primary sensing device group for a respective gateway, where the pairing is predefined independently of a relative position between the primary sensing device group and the respective gateway, and wherein each gateway providing each sensing device in the primary sensing device group for a different gateway with a redundant gateway.

15. The distributed remote sensing system of claim 14, wherein the distributed remote sensing system comprises a parking monitoring system.

16. The distributed remote sensing system of claim 14, wherein each gateway has a different frequency switching scheme for communicating with the sensing devices.

17. The distributed remote sensing system of claim 14, further comprising a central controller, each gateway being configured to communicate with the central controller through a respective wireless access point.

18. A distributed remote sensing system comprising:

a central controller;

at least one wireless access point, wherein the at least one wireless access point is configured to communicate with the central controller; and a group of gateways where each gateway is paired with a group of sensing devices to define a primary sensing device group for a respective gateway, wherein the primacy of the primary sensory device group is predefined independently of a relative position between the primary sensing device group and the respective gateway, and where the group of gateways provide at least two levels of redundancy for communication within the distributed remote sensing system.

19. The distributed remote sensing system of claim 18, wherein the distributed remote sensing system comprises a parking monitoring system.

20. A distributed remote sensing system comprising:

a central controller;

at least one wireless access point, wherein the at least one wireless acess point is configured to communicate with the central controller; and a group of gateways where each gateway is paired with a group of sensing devices to define a primary sensing device group, each sensing device of each group of sensing devices being distinct from each of the at least one wireless access point, and where the group of gateways provide at least two levels of redundancy for communication within the distributed remote sensing system, wherein each of the gateways is configured so that the gateway switches between more than one of the at least one wireless access point for communication with the central controller when one of the at least one wireless access point is unavailable.

21. The distributed remote sensing system of claim 18, wherein each gateway is configured to store messages from the sensing devices when communication to the central controller through the at least one wireless access point is unavailable.

22. The distributed remote sensing system of claim 18, wherein each gateway is a redundant gateway to a group of sensing devices paired with a different gateway to define a redundant sensing device group.

23. The distributed remote sensing system of claim 18, wherein each gateway communicates with the primary sensing device group and the redundant sensing device group over a common communication channel.

24. The distributed remote sensing system of claim 18, wherein each gateway communicates with respective sensing devices using time division duplexing.

25. A method comprising:

pairing at least one gateway with a primary communicator and at least one secondary communicator for providing communication between the at least one gateway and a central controller;

switching with the at least one gateway from the primary communicator to the at least one secondary communicator when communication between the at least one gateway and the primary communicator is unavailable; and storing messages within the at least one gateway when communication between the at least one gateway and the at least secondary communicator is unavailable.

26. The method of claim 25, further comprising transmitting the messages when communication with the primary or the at least one secondary communicator is re-established.

* * * * *